US011117376B2

(12) United States Patent
Choy et al.

(10) Patent No.: US 11,117,376 B2
(45) Date of Patent: Sep. 14, 2021

(54) PRINTHEAD ASSEMBLY

(71) Applicant: HEWLETT-PACKARD DEVELOPMENT COMPANY, L.P., Houston, TX (US)

(72) Inventors: Si-lam J. Choy, Corvallis, OR (US); Devin Mourey, Albany, OR (US); Eric L. Nikkel, Philomath, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/226,904

(22) Filed: Dec. 20, 2018

(65) Prior Publication Data

US 2019/0118535 A1 Apr. 25, 2019

Related U.S. Application Data

(63) Continuation of application No. 15/507,043, filed as application No. PCT/US2014/053239 on Aug. 28, 2014, now Pat. No. 10,195,852.

(51) Int. Cl.

| | |
|---|---|
| ***B41J 2/16*** | (2006.01) |
| ***B41J 2/14*** | (2006.01) |
| ***B41J 2/155*** | (2006.01) |

(52) U.S. Cl.

CPC ..... *B41J 2/1637* (2013.01); *B41J 2/14024* (2013.01); *B41J 2/14072* (2013.01); *B41J 2/155* (2013.01); *B41J 2/1603* (2013.01); *B41J 2/1408* (2013.01); *B41J 2202/20* (2013.01)

(58) Field of Classification Search

CPC ..... B41J 2/14; B41J 2/14024; B41J 2/14072; B41J 2/155; B41J 2202/20; B41J 25/304

See application file for complete search history.

(56) References Cited

U.S. PATENT DOCUMENTS

| | | | |
|---|---|---|---|
| 4,633,274 | A | 12/1986 | Matsuda |
| 4,873,622 | A | 10/1989 | Komuro et al. |
| 6,464,333 | B1 | 10/2002 | Scheffelin et al. |
| 6,548,895 | B1 | 4/2003 | Benavides et al. |
| 6,896,359 | B1 | 5/2005 | Miyazaki et al. |
| 2002/0051036 | A1 | 5/2002 | Scheffelin et al. |
| 2002/0157252 | A1 | 10/2002 | Silverbrook |
| 2003/0007034 | A1 | 1/2003 | Horvath et al. |
| 2004/0017436 | A1 | 1/2004 | Watanabe |

(Continued)

FOREIGN PATENT DOCUMENTS

| | | |
|---|---|---|
| JP | 60262649 | 12/1985 |
| JP | 08025638 | 1/1996 |

(Continued)

*Primary Examiner* — Scott A Richmond

(74) *Attorney, Agent, or Firm* — Dierker & Kavanaugh PC

(57) ABSTRACT

A printhead assembly may include a first set of distinct parallel printhead dies in a second set of distinct parallel printhead dies. The first set of distinct parallel printhead dies may have respective major dimensions extending in a longitudinal direction and respective ends that are aligned in a transverse direction. The second set of distinct parallel printhead dies may have respective major dimensions extending in the longitudinal direction and respective ends aligned in the transverse direction. The second set of distinct parallel printhead dies may partially overlap the first set of distinct parallel printhead dies in the transverse direction.

5 Claims, 10 Drawing Sheets

(56) References Cited

U.S. PATENT DOCUMENTS

| | | | | |
|---|---|---|---|---|
| 2006/0221133 | A1 | 10/2006 | Harada | |
| 2009/0011185 | A1* | 1/2009 | Giri | B41J 2/1634 428/136 |
| 2011/0037808 | A1* | 2/2011 | Ciminelli | B41J 2/1637 347/50 |
| 2011/0292124 | A1 | 12/2011 | Anderson et al. | |
| 2012/0019593 | A1* | 1/2012 | Scheffelin | B41J 2/14024 347/40 |
| 2012/0229542 | A1 | 9/2012 | Kida | |
| 2014/0145142 | A1 | 5/2014 | Zhang | |
| 2014/0203457 | A1* | 7/2014 | Kim | H01L 25/0657 257/778 |
| 2015/0276144 | A1 | 10/2015 | Tudhope | |
| 2016/0009082 | A1* | 1/2016 | Chen | B41J 2/1404 347/40 |
| 2016/0023461 | A1* | 1/2016 | Chen | B41J 2/14016 347/50 |
| 2016/0096366 | A1* | 4/2016 | Chen | B41J 2/14201 347/44 |

FOREIGN PATENT DOCUMENTS

| | | |
|---|---|---|
| JP | 2004042654 | 2/2004 |
| JP | 2006321222 | 11/2006 |
| JP | 2010023341 | 2/2010 |
| JP | 2012183747 | 9/2012 |
| JP | 2013501655 | 1/2013 |
| WO | WO-2006112526 | 10/2006 |

* cited by examiner

PRINTHEAD ASSEMBLY

CROSS-REFERENCE TO RELATED PATENT APPLICATIONS

The present application is a continuation application claiming priority under 35 USC § 120 from U.S. patent application Ser. No. 15/507,043 which is a US 371 national application of PCT/US2014/053239 filed by Silam Choy on Aug. 28, 2014 and entitled PRINTHEAD ASSEMBLY, the full disclosures each of which are hereby incorporated by reference.

BACKGROUND

Molded inkjet printheads have been developed to break the connection between the size of the printhead die needed for the ejection chambers and the spacing needed for fluidic fan-out. The new molded printheads enable the use of tiny printhead die "slivers" such as those described in international patent application number PCT/US2013/046065, filed Jun. 17, 2013 titled Printhead Die.

DRAWINGS

The same part numbers designate the same or similar parts throughout the figures.

DESCRIPTION

Figure 1:
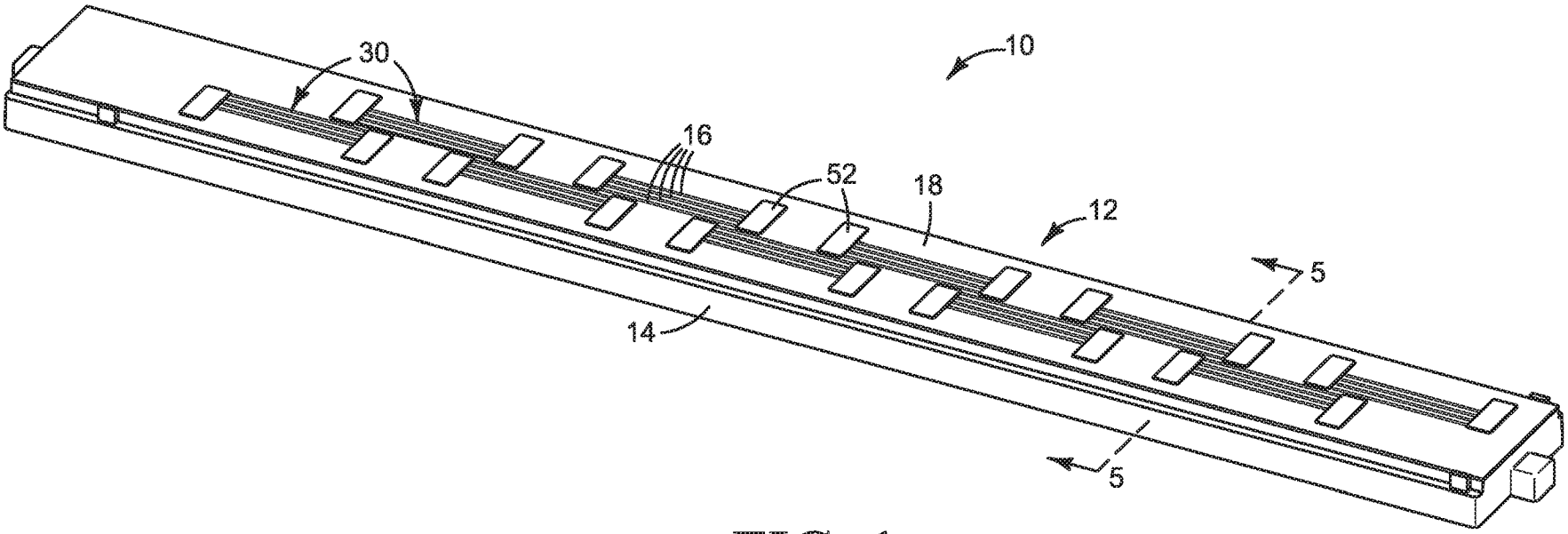
FIG. 1 illustrates one example of a print bar that includes a molded printhead assembly affixed to a flow structure, with the printhead assembly facing up.

One challenge presented by using tiny printhead die slivers is making a strong structure with robust electrical connections. A printed circuit board (PCB) can be included to strengthen the structure and the electrical connections. The printed circuit board, however, should be protected from the corrosive effects of inks and other printing fluids supplied to and dispensed from the printhead dies to help maintain the structural and electrical integrity of the printhead assembly. Accordingly, a new printhead assembly has been developed to realize the advantages of integrating a printed circuit board into the molded printhead assembly while protecting the printed circuit board from the corrosive effects of ink and other printing fluids.

In one example, a printhead assembly includes a molding with multiple printhead die slivers and a printed circuit board affixed to the back part of the molding. The face of each die sliver is exposed at the front part of the molding and channels in the back part of the molding carry printing fluid to the die slivers. Bond wires electrical connect each die sliver to conductors in the printed circuit board. In this example, the printhead assembly also includes a discrete flow structure with passages that carry printing fluid to the channels in the molding, for example from an upstream supply system. The flow structure is affixed to the molding with an adhesive that seals off the printed circuit board from the passages in the flow structure and from the channels in the molding. Thus, the printed circuit board is isolated both from printing fluid carried to the die slivers at the back part of the molding and from printing fluid dispensed from the face of the die slivers at the front part of the molding. While it is expected that examples of the new printhead assembly usually will be implemented in a media wide print bar, examples could also be implemented in a scanning type inkjet pen or in other inkjet type printing devices.

This and other examples shown in the figures and described below illustrate but do not limit the scope of the invention, which is defined in the Claims following this Description.

As used in this document, a "printhead" and a "printhead die" mean that part of an inkjet printer or other inkjet type dispenser that dispenses fluid from one or more openings; a printhead die "sliver" means a printhead die with a ratio of length to width of 50 or more; and a "print bar" means an arrangement of one or more printheads that is intended to remain stationary during printing. A printhead includes a single printhead die or multiple printhead dies. "Printhead" and "printhead die" are not limited to printing with ink and other printing fluids but also include inkjet type dispensing of other fluids and/or for uses other than printing.

FIGS. 1-6 illustrate a print bar 10 implementing one example of a molded printhead assembly 12 affixed to a flow structure 14. Printhead assembly 12 includes multiple printhead dies 16 molded into or otherwise embedded in a molding 18. While any size printhead die 16 may be used, die slivers are particularly well suited for printhead assembly 12. Printing fluid is dispensed from the face 20 (FIGS. 6-8) of each printhead die 16 exposed along the front part 22 of molding 18. Channels 24 are formed in the back part 26 of molding 18 to carry printing fluid to the back part 28 of corresponding printhead dies 16.

In the example shown, printhead dies 16 are grouped together as printheads 30 arranged generally end to end along the length of molding 18 in a staggered configuration in which the dies in each printhead overlap the dies in an adjacent printhead. Each printhead 30 includes four dies 16 arranged parallel to one another laterally across molding 18, to print four different color inks for example. More or fewer printhead dies 16 and printheads 30 and/or in other arrangements are possible. Also, examples of the new molded printhead assembly are not limited to a media wide print bar 10. A molded printhead assembly 12 could also be implemented, for example, in a scanning type inkjet pen with fewer molded printhead dies or even a single molded printhead die.

Figure 4:
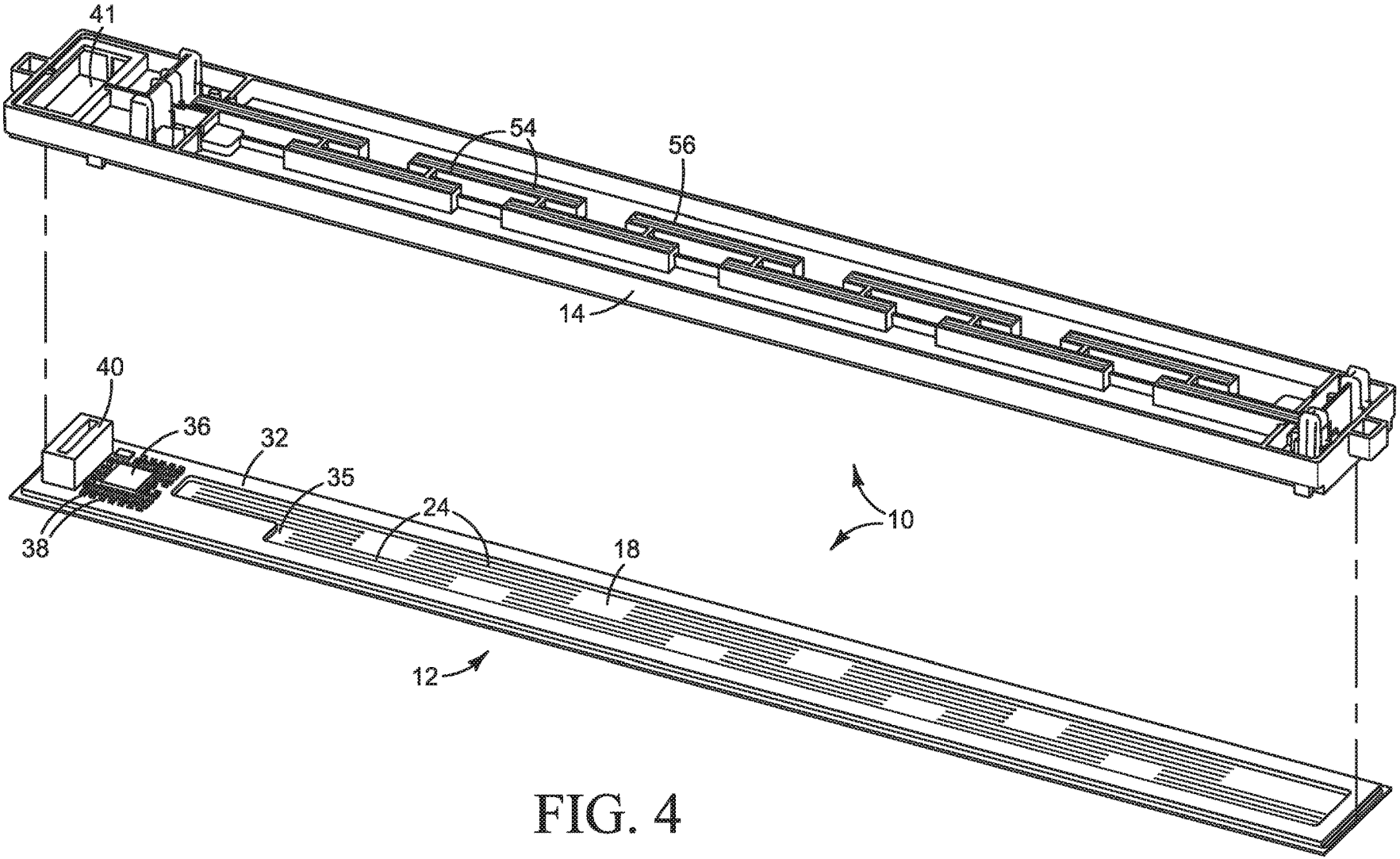
FIG. 4 is an exploded view of the print bar of FIG. 1 showing the upstream part of the printhead assembly and the flow structure.
Figure 5:
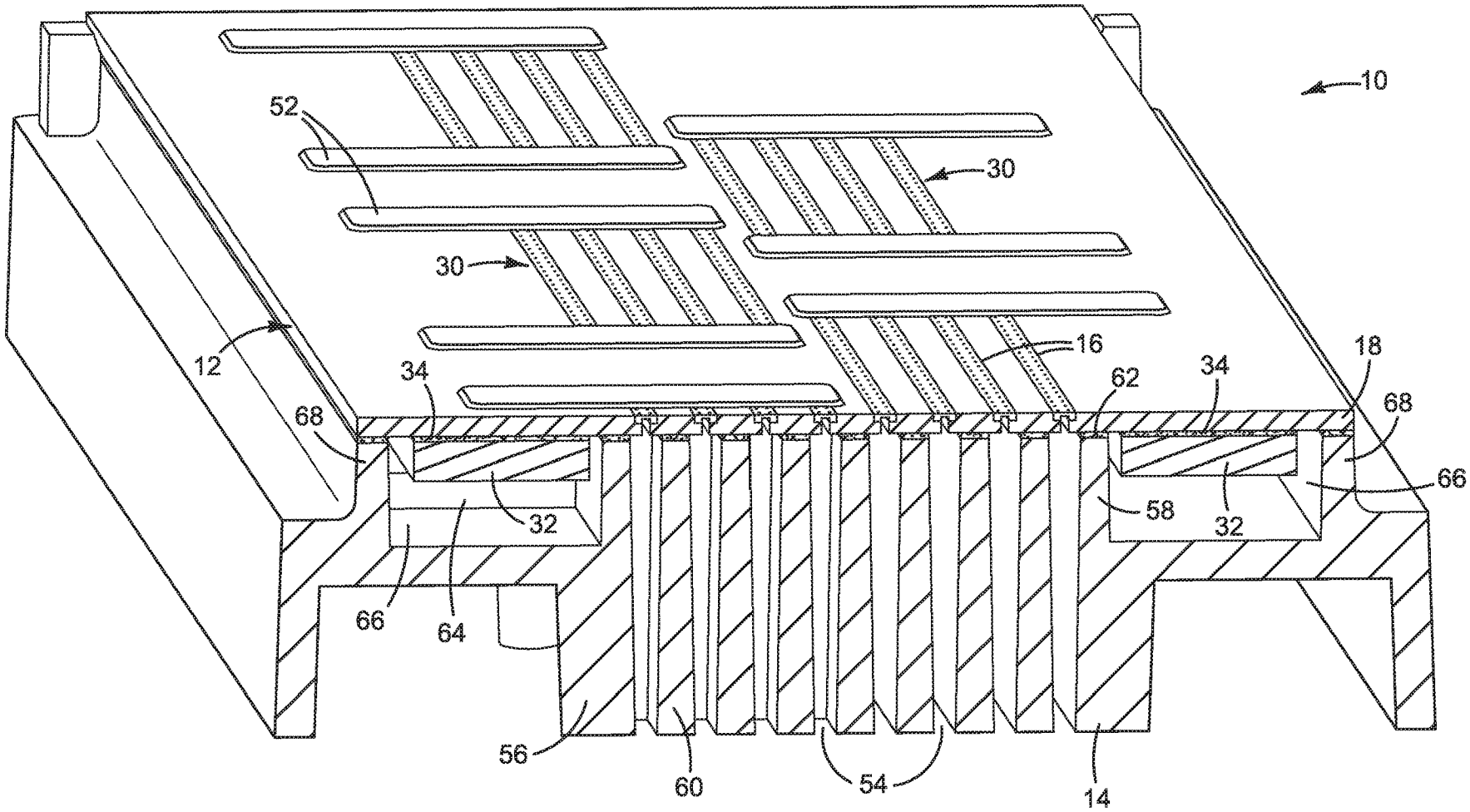
FIG. 5 is a section taken along the section line 5-5 in FIG. 1.

Printhead assembly 12 includes a printed circuit board (a "PCB") 32 affixed to the back part 26 of molding 18, for example with an adhesive 34 (FIG. 5). A printed circuit board is also commonly referred to as a printed circuit assembly (a "PCA"). PCB 32 does not cover any of the printing fluid flow channels 24 in molding 18. In this example, as seen in FIG. 4, channels 24 are exposed through an opening 35 in PCB 32 such that PCB 32 surrounds channels 24. While the distance between PCB 32 and the nearest channel 24 may vary depending on the technique and structure used to protect PCB 32 from the ink or other printing fluid in channels 24, it is expected that a distance of at least 0.5 mm will be sufficient in most implementations to isolate PCB 32 from channels 24.

Each printhead die 16 is electrically connected to conductors (not shown) in PCB 32 to connect ejector and other elements in the dies to power and control electronics, including for example an ASIC 36, surface mounted devices 38, and/or a pin connector 40. Pin connector 40 is accessible through an opening 41 in flow structure 14 to connect to external circuits. In this example, and referring specifically to the detail of FIG. 7, printhead dies 16 are connected to the PCB through bond wires 42. Also in this example, outboard printhead dies are connected directly to the PCB while inboard dies are connected indirectly to the PCB through an adjacent die. The wire bonds are made between bond pads 44 exposed at the face 20 of each die 16 and to bond pads 46 on PCB 32. PCB bond pads 46 are exposed through holes 48 in molding 18. Bond wires 42 may be covered by an epoxy or other suitable protective material 50 (FIG. 6) and a flat cap 52 added to form a lower profile protective covering on the bond wires.

Figure 2:
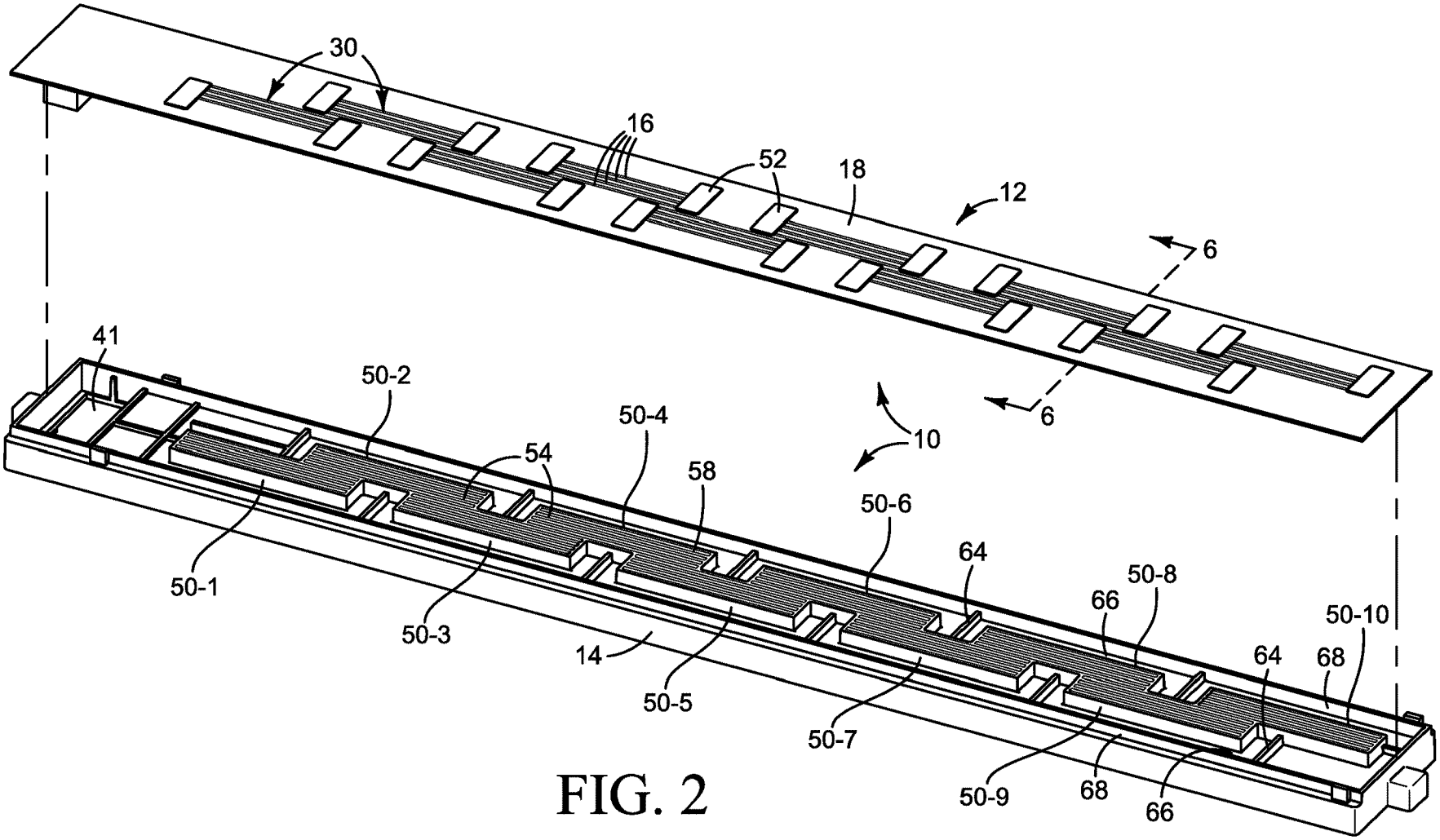
FIG. 2 is an exploded view of the print bar of FIG. 1 showing the downstream part of the printhead assembly and the flow structure.
Figure 3:
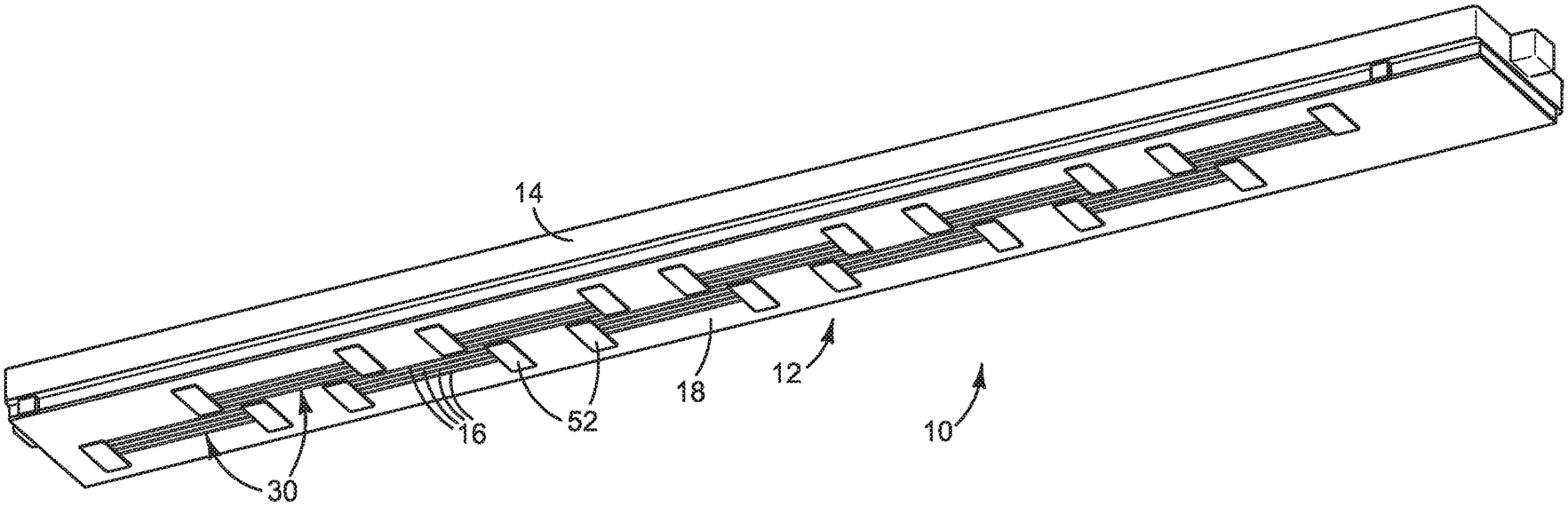
FIG. 3 illustrates the print bar of FIG. 1 with the printhead assembly facing down (the usual orientation of the print bar in a printer).

As been seen in FIGS. 2, 4 and 5, flow structure 14 comprises pedestals 50-1, 50-2, 50-3, 50-4, 50-5, 50-6, 50-7, 50-8, 50-9, and 50-10 (collectively referred to as pedestals 50). Each of pedestals 50 comprises protruding platforms that back respective sets of printhead dies 16. Pedestals 60 partially overlap one another in the transverse direction. Each of pedestals 50 includes passages 54 through which printing fluid may flow from an upstream part 56 of the flow structure to channels 24 at a downstream part 58 of the flow structure. Passages 54 are defined in part by sidewalls 60 that intersect molding 18 adjacent to each channel 24. Flow structure 14 is affixed to molding 18 with an adhesive or other suitable sealant 62 that seals off PCB 32 from passages 54 and channels 24. Sealant 62 isolates PCB 32 from printing fluid carried to the dies at the back part of molding 18 and, as noted above, positioning PCB 32 at the back part of molding 18 isolates the PCB from printing fluid dispensed from the face of the dies at the front part of the molding. Thus, PCB 32 is completely isolated from exposure to ink and other printing fluids.

A "backside" PCB printhead assembly such as that shown in the figures eliminates the need to apply a protective coating to the PCB or to require ink-resistant PCB materials. Also, examples of the new molded printhead assembly enable thinner moldings and otherwise promote a greater range of options for molding the printhead dies. In the example shown, PCB 32 is supported on a series of bars 64 in a cavity 66 in flow structure 14 as best seen in FIGS. 2 and 5. It may be desirable in some implementations to support the PCB in a cavity such as that shown in FIGS. 2 and 5 to help the PCB and components mounted to the PCB withstand external loads that may occur, for example when handling the printhead assembly or during printhead servicing (e.g., wiping and capping). Also, PCB 32 may be sealed in cavity 66 along a surrounding, exterior wall 68 if desired to help prevent printing fluid residue and other external contaminants from reaching the PCB.

Referring now to FIGS. 6-9, each printhead 30 includes four printhead dies 16. Each die 16 includes two rows of dispensing chambers 70 and corresponding orifices 72 through which printing fluid is dispensed from chambers 70. Each channel 24 in molding 18 supplies printing fluid to one printhead die 16. Other suitable configurations for printhead 30 are possible. For example, more or fewer printhead dies 16 may be used with more or fewer chambers 70, orifices 72 and channels 24.

Figure 8:
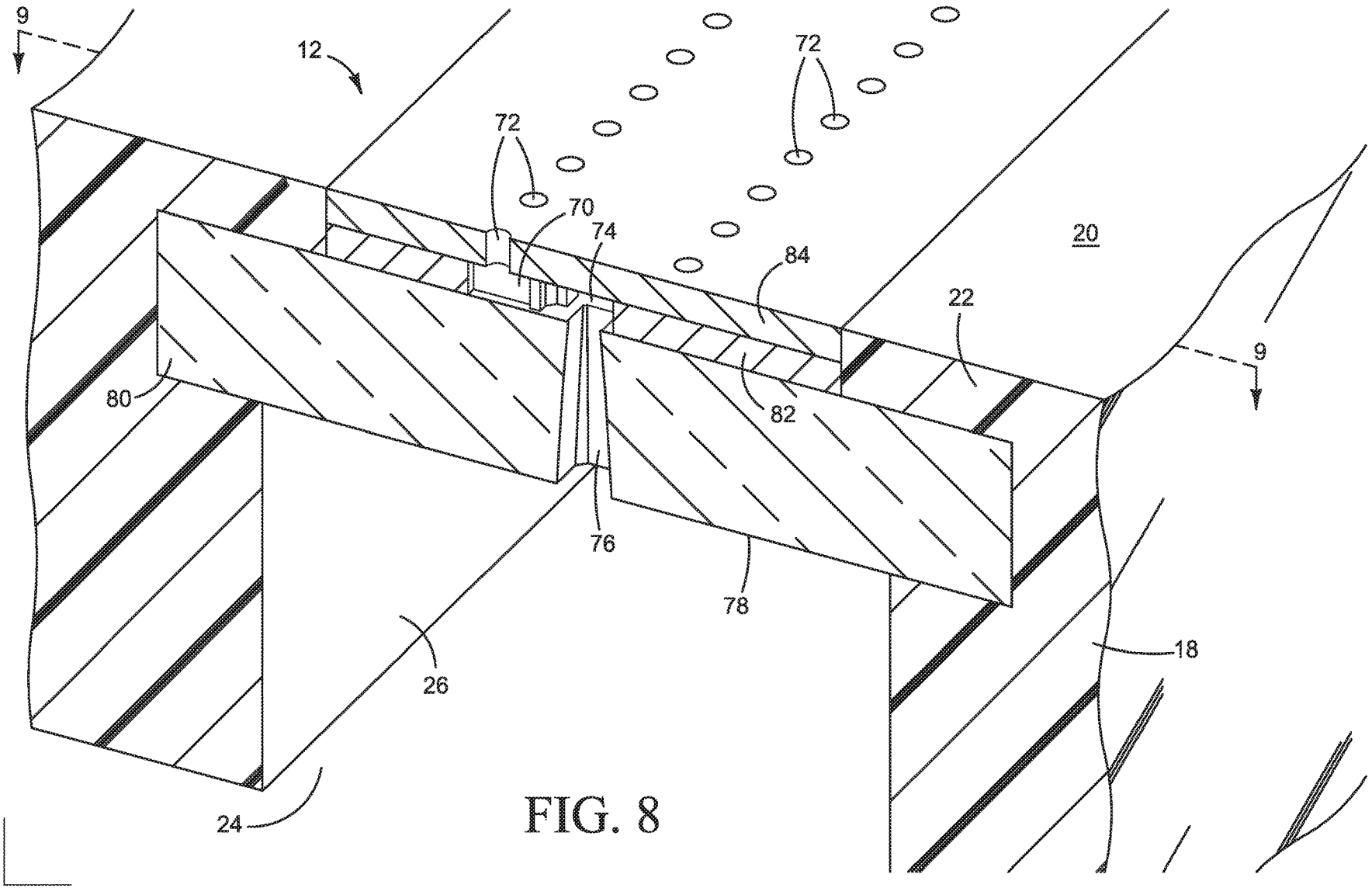
Figure 9:
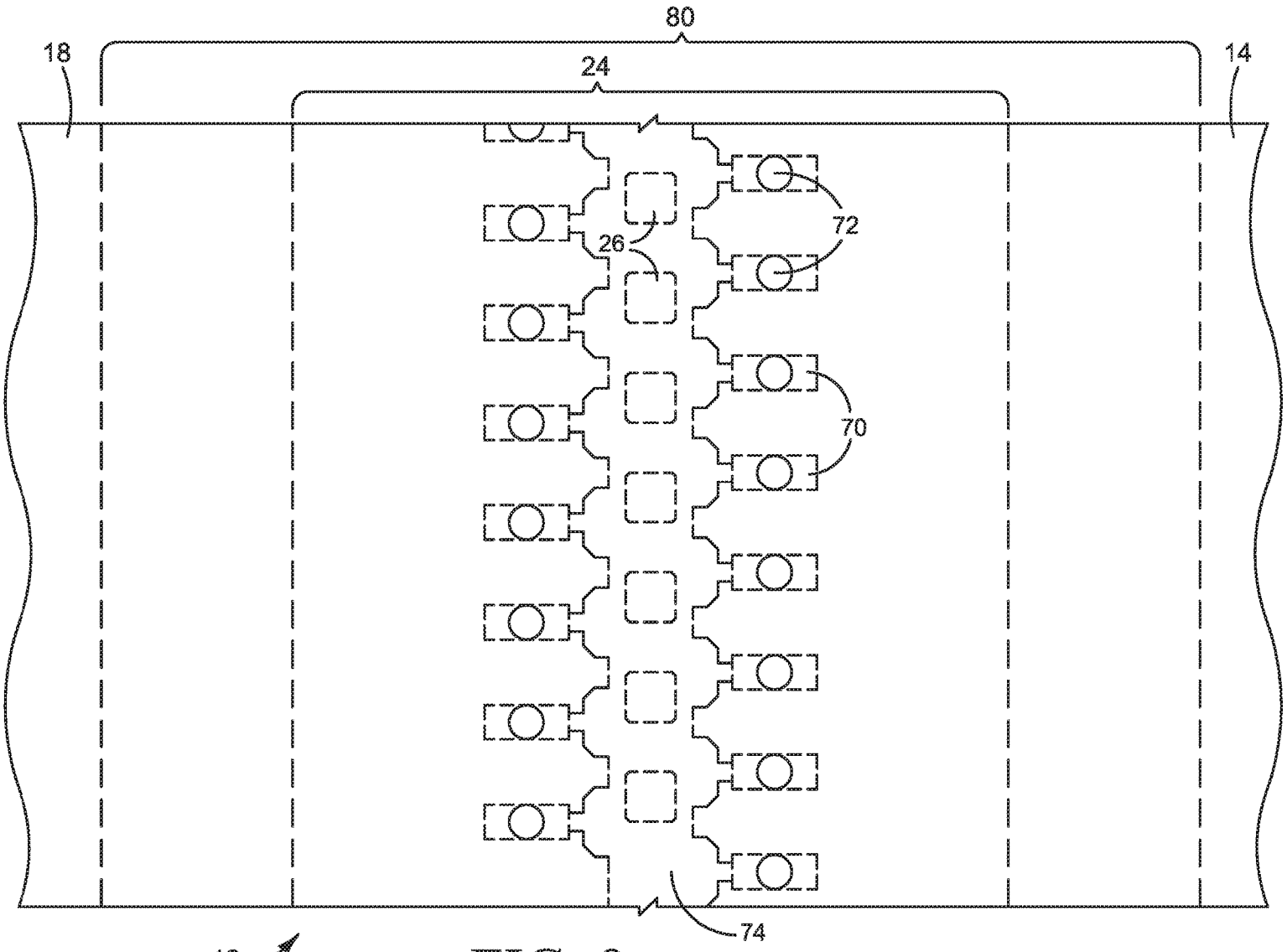
FIG. 9 is a plan view taken along the view line 9-9 in FIG. 8.

Referring specifically to FIGS. 8 and 9, printing fluid flows into each dispensing chamber 70 from a manifold 74 extending lengthwise along each die 16 between chambers 70. Printing fluid feeds into manifold 74 through multiple ports 76 that are connected to a printing fluid supply channel 24 at die surface 78. Printing fluid supply channel 24 is substantially wider than printing fluid ports 76, as shown, to carry printing fluid from larger, loosely spaced passages 54 in flow structure 14 to the smaller, tightly spaced printing fluid ports 76 in printhead die 16. Thus, printing fluid supply channels 24 in molding 18 can help reduce the need for a discrete "fan-out" structure used in other types of printheads. The idealized representation of a printhead die 16 in FIG. 8 depicts three layers 80, 82, 84 for convenience only to clearly show dispensing chambers 70, orifices 72, manifold 74, and ports 76. An actual inkjet printhead die 16 is a typically complex integrated circuit (IC) structure formed on a silicon substrate 80 with layers and elements not shown in FIG. 8. For example, a thermal ejector element or a piezoelectric ejector element formed on substrate 80 at each chamber 70 is actuated to eject drops or streams of ink or other printing fluid from orifices 72.

Figure 6:
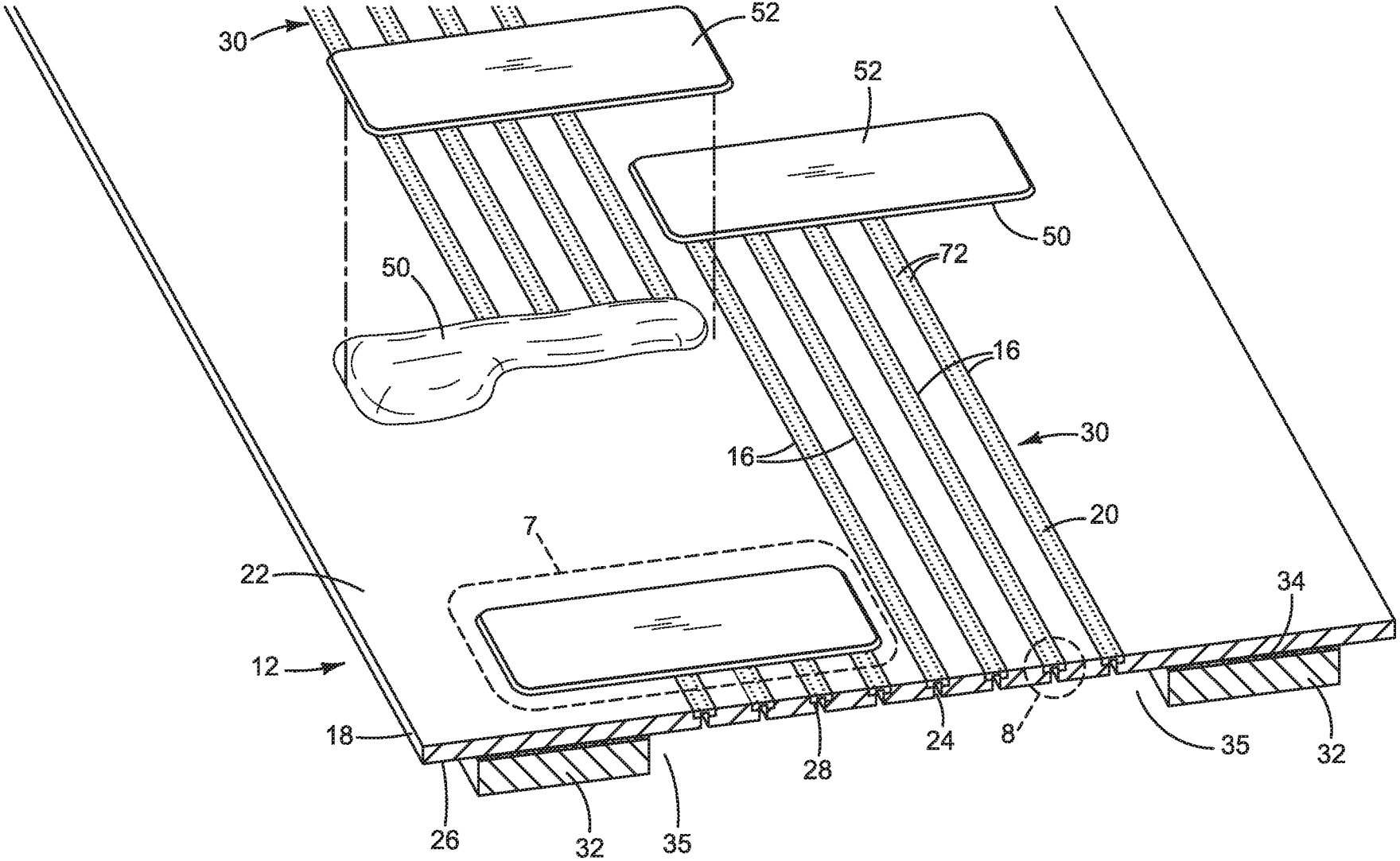
FIG. 6 is a section taken along the section line 6-6 in FIG. 2.
Figure 7:
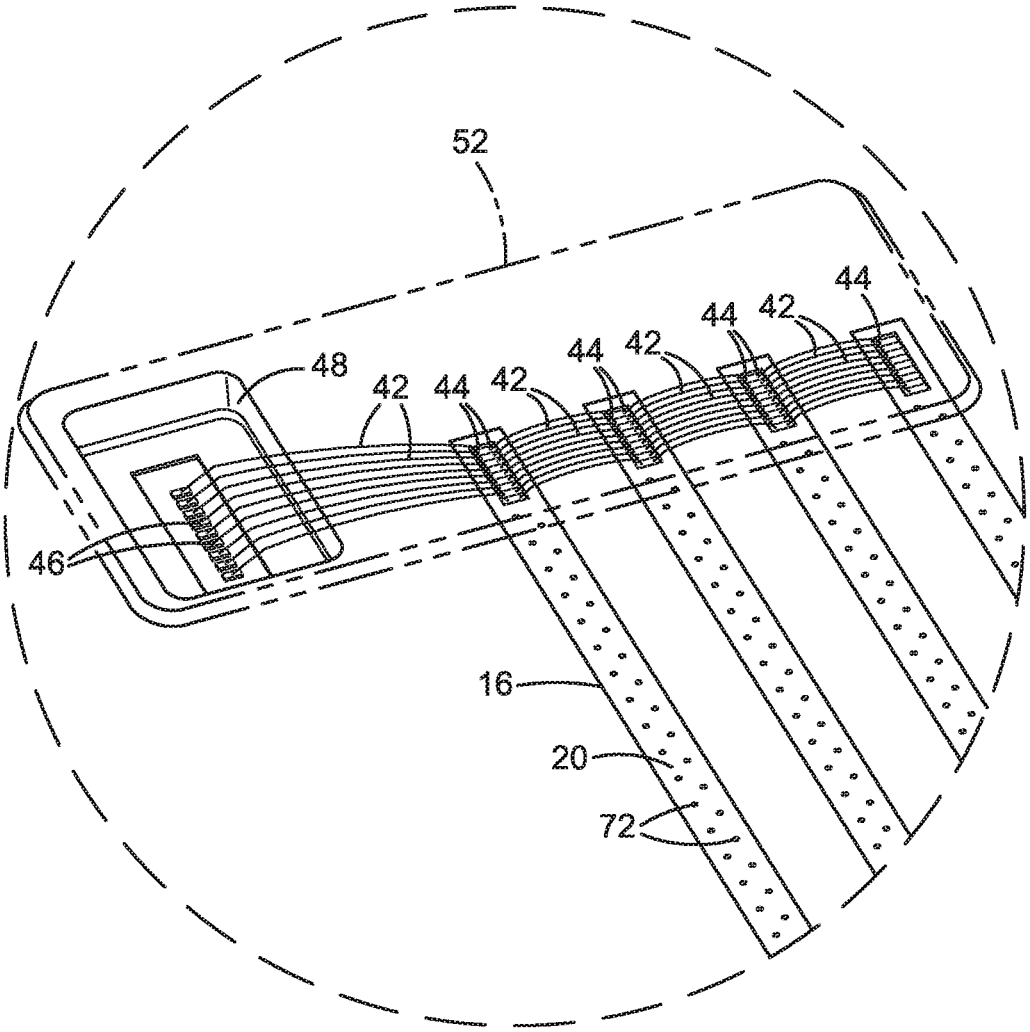
FIGS. 7 and 8 are details from FIG. 6.
Figure 10:
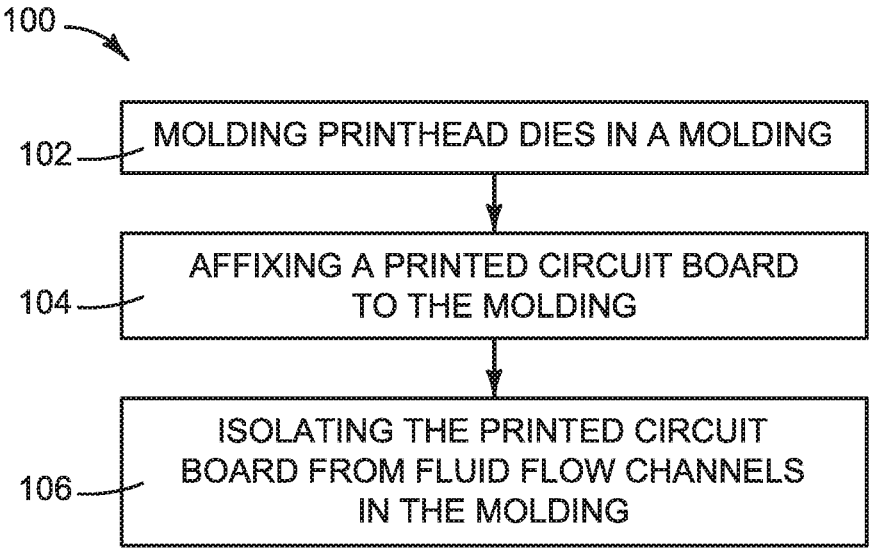
FIG. 10 illustrates one example of a process for making a printhead assembly such as the printhead assembly shown in FIGS. 1-6.

FIG. 10 illustrates one example of a process 100 for making a printhead assembly such as printhead assembly 12 shown in FIGS. 1-6. Referring to FIG. 10, process 100 includes molding printhead dies in a molding (block 102), affixing a printed circuit board to the molding (block 104), and isolating the printed circuit board from fluid flow channels in the molding (block 106). Isolating the printed circuit board from fluid flow channels in the molding may be achieved, for example, by sealing off the printed circuit board from the channels, as shown in FIG. 5. Process 100 may also include isolating the printed circuit board from the face of the dies, for example, by affixing the printed circuit board to the back part of the molding, as shown in FIG. 6. ("Affixing a printed circuit board to the molding" does not mean that the molding is held stationary while the printed circuit board is applied to the molding. Rather, affixing the printed circuit board to the molding means the two parts are affixed to one another, without regard to any particular sequence for joining the two parts together.)

"A" and "an" as used in the Claims means one or more.

As noted at the beginning of this Description, the examples shown in the figures and described above illustrate but do not limit the scope of the invention, which is defined in the following Claims.

What is claimed is:

1. A printhead assembly comprising:

a first set of distinct parallel printhead dies having respective major dimensions extending in a longitudinal direction and respective ends that are aligned in a transverse direction;

a second set of distinct parallel printhead dies having respective major dimensions extending in the longitudinal direction and respective ends aligned in the transverse direction, wherein the second set of distinct parallel printhead dies partially overlap the first set of distinct parallel printhead dies in the transverse direction;

wherein the first set of distinct parallel printhead dies comprises a first printhead die and a second printhead die;

the printhead assembly further comprising a printed circuit board;

wherein the first printhead die is indirectly connected to the printed circuit board by bond wires of the first printhead die electrically connected to first bond pads of the second printhead die, the first bond pads of the second printhead die being electrically connected to second bond pads of the second printhead die; and wherein the second bond pads of the second printhead die are electrically connected to the printed circuit board.

2. The printhead assembly of claim 1 comprising a unitary molding supporting and retaining the first set of distinct parallel printhead dies and the second set of distinct parallel printhead dies, wherein the first set of distinct parallel printhead dies and the second set of distinct parallel printhead dies are embedded into the unitary molding with the unitary molding extending adjacent to a back face and opposing sides of each printhead die of the first set of distinct parallel printhead dies and the second set of distinct parallel printhead dies.

3. A printhead assembly comprising:

a first set of distinct parallel printhead dies having respective major dimensions extending in a longitudinal direction and respective ends that are aligned in a transverse direction;

a second set of distinct parallel printhead dies having respective major dimensions extending in the longitudinal direction and respective ends aligned in the transverse direction, wherein the second set of distinct parallel printhead dies partially overlap the first set of distinct parallel printhead dies in the transverse direction;

a printed circuit board;

a molding having a set of channels to deliver fluid to respective printhead dies of the first set of printhead dies; and a flow structure having a set of passages to deliver fluid to respective channels of the set of channels, the flow structure being affixed to the molding with an adhesive that seals off the printed circuit board from the passages and channels.

4. A printhead assembly comprising:

a molding with multiple printhead dies exposed at a front part of the molding and fluid flow channels in a back part of the molding to carry printing fluid to the dies, each die having orifices therein extending from a first face of the die at the front part of the molding to a second face opposite the first face, the molding contacting the first face and the second face of each die; and a printed circuit board affixed to the back part of the molding, the printed circuit board isolated from the fluid flow channels in the molding so that the printed circuit board is not exposed to printing fluid in the channels.

5. The printhead assembly of claim 4, wherein printing fluid may be dispensed from the orifices at the first face of each die and the printed circuit board is isolated from the first face of each die so that the printed circuit board is not exposed to printing fluid dispensed from the orifices.

* * * * *